United States Patent [19]

Cremonesi

[11] Patent Number: 4,687,028

[45] Date of Patent: Aug. 18, 1987

[54] NEGATIVE DOBBY FOR WEAVING LOOMS

[75] Inventor: Gianluigi Cremonesi, Ponte Nossa, Italy

[73] Assignee: Fimtessile Fabbrica Italiana Macchinario Tessile S.p.A., Ponte Nossa, Italy

[21] Appl. No.: 853,954

[22] Filed: Apr. 21, 1986

[30] Foreign Application Priority Data

Apr. 24, 1985 [IT] Italy ..... 20487 A/85

[51] Int. Cl.[4] ..... D03C 1/06

[52] U.S. Cl. ..... 139/71

[58] Field of Search ..... 139/66 R, 68, 71, 72, 139/73

[56] References Cited

U.S. PATENT DOCUMENTS

| | | | |
|---|---|---|---|
| 2,085,459 | 6/1937 | Wiget | 139/68 |
| 3,381,719 | 5/1968 | Faure | 139/71 |
| 3,441,060 | 4/1969 | Schwarz | 139/71 |

FOREIGN PATENT DOCUMENTS

| | | | |
|---|---|---|---|
| 162831 | 8/1985 | Japan | 139/68 |
| 472517 | 6/1969 | Switzerland | 139/71 |

*Primary Examiner*—Henry S. Jaudon

*Attorney, Agent, or Firm*—Stevens, Davis, Miller & Mosher

[57] ABSTRACT

In a negative dobby for forming the warp shed in weaving looms, the stresses on some of the machine components are greatly reduced, whereby a more precise control of the heald frames is obtained, thanks to the fact that the controls transmitted to the crooks (9, 10), engaging the hooks (7, 8), by the means (12) reading the pattern of the fabric to be woven, are no longer affected by the strains deriving from the stresses imparted on said crooks (9, 10). This is obtained by operating the crooks (9, 10) by means of two-armed levers (13), controlled by the spiked roller (12)—forming the pattern reading means—and connected by spring means (17) to a square arm (18) of said crooks (9, 10), the rocking movements of said crooks (9, 10) and of said two-armed levers (13) being controlled by two distinct shafts (9A, 14).

3 Claims, 3 Drawing Figures

NEGATIVE DOBBY FOR WEAVING LOOMS

BACKGROUND OF THE INVENTION

The present invention concerns improvements in negative dobbies for forming the warp shed in weaving looms. The object of these improvements is to reduce the stresses on some of the machine components and to obtain a more precise control of the heald frames, so as to allow a more efficient and rational use of the dobby in combination with looms working at high and very high speeds, as those already in use and now increasingly expanding.

In technique there are known to be negative dobbies for looms, wherein the engagement between the hooks pivoted on the rockers and the respective crooks, takes place after such crooks—already positioned for engagement—have been caused to oscillate by the hooks. In the known arrangements of this type, some of the members operating the crooks—under control of the means reading the pattern of the fabric to be woven—are mounted on the same rocking shaft of the crooks, said shaft being subject, while the dobby is operating, to the stresses imparted on said crooks by the hooks. The drawback of these arrangements—especially when the stresses are particularly high and frequent, as in the case of dobbies equipping very fast looms—is to greatly reduce the precision of the controls transmitted to the crooks and thus to the heald frames, on account of the strains determined by said stresses.

SUMMARY OF THE INVENTION

To overcome this drawback, and also reduce the stresses on some of the machine components, the present invention provides for a constructive arrangement of the negative dobby, wherein the controls transmitted by the pattern reading means to the crooks engaging the hooks, are no longer affected by the strains deriving from the stresses imparted on said crooks.

This is obtained with a negative dobby—of the type wherein the rocking movements imparted on the rockers, which control the shifting of the heald frames, by a pair of movable cross members, are controlled by hooks pivoted to the ends of said rockers and by crooks cooperating with said hooks and operated by the means reading the pattern of the fabric to be woven—characterized in that the oscillating movements of the crooks are controlled by rocking levers having two arms, a first arm cooperating with the pattern reading means, while the second arm is elastically connected to a square arm of said crooks, stop means being interposed between the second arm of said two-armed levers and the square arm of said crooks, spring return means being provided for said crooks, and the rocking movements of said crooks and of said two-armed levers being controlled by two distinct shafts.

Said stop means suitably consist of a stiff bar, pivotally mounted on the square arm of the crooks and apt to be freely inserted and to rotate into an open slot of the second arm of said two-armed levers.

Furthermore, said two-armed levers are advantageously mounted on their shaft so as to rotate thereon only for a short arc, the rotation being limited by a key of said shaft engaging into a wide circumferential slot of the layer.

BRIEF DESCRIPTION OF THE DRAWINGS

The invention is now described in further detail, by mere way of example, with reference to the accompanying drawings, which illustrate a practical embodiment thereof and in which.

DESCRIPTION OF THE PREFERRED EMBODIMENT

As known, dobbies are mechanisms for forming the warp shed in weaving looms, starting from a prearranged pattern of the fabric to be woven, which is coded onto a punched tape or onto a spiked roller or like and the reading of which allows to operate rocking levers which control the movements of the heald frames.

The conventional dobbies include positive dobbies, wherein the heald frames are positively controlled in their upward and downward movements, overcoming the reaction of the stretched warp yarns, and negative dobbies, wherein the heald frames are controlled only in one direction, in opposition to return spring means. The present invention concerns, as already said, a dobby of the second type.

Figure 1:
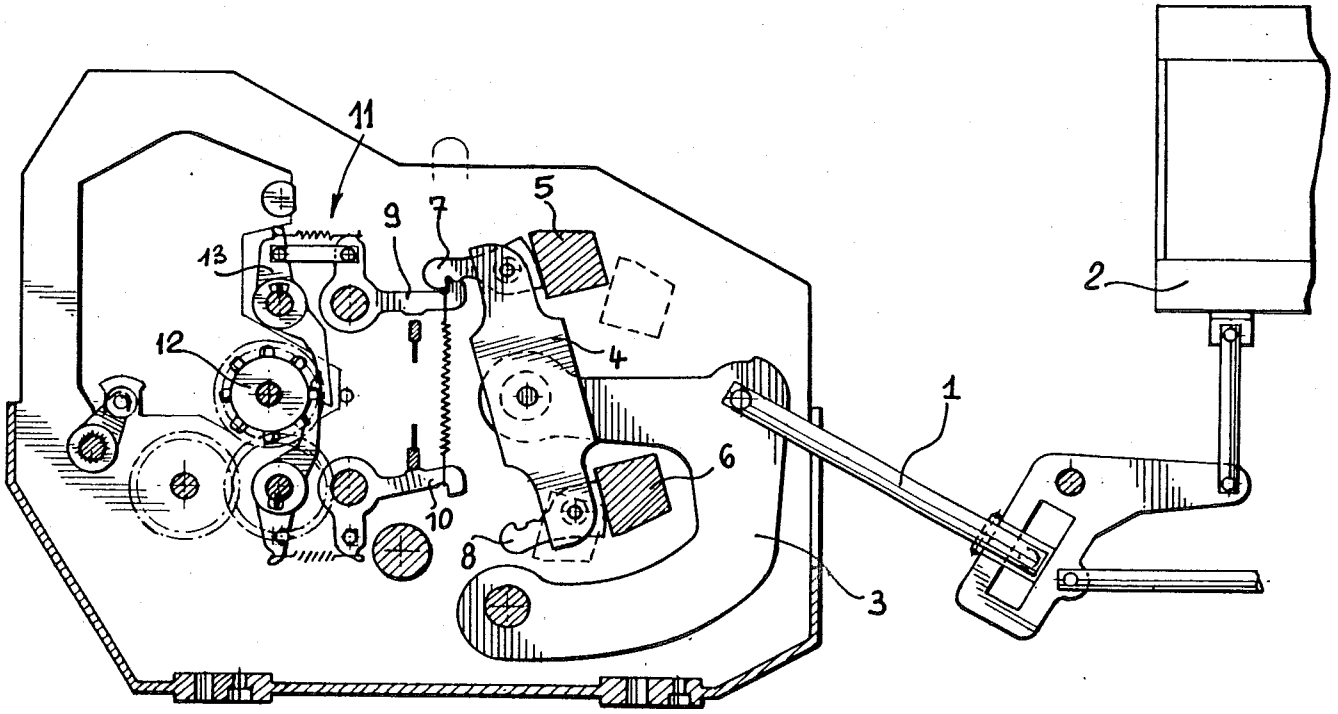
FIG. 1 is a general schematic view of the negative dobby according to the invention.

FIG. 1 of the accompanying drawings is a schematic view of the negative dobby according to the invention—showing the control of a single heald frame—wherein a drawrod 1 for shifting the heald frame 2 is pivotally connected, at its controlled end, to a rocking lever 3 of the rocker 4. Said rocker 4 is rocked in known manner by two movable cross members 5 and 6, connected to a control mechanism (not shown), and carries hooks 7 and 8 pivoted to its ends, said cross members 5 and 6 pressing onto the rear end of said hooks 7 and 8, which are designed to cooperate with respective crooks 9 and 10 controlled, by way of a spring and lever system 11, by a spiked roller 12 onto which is coded the pattern of the fabric to be woven.

According to the controls is received from the spiked roller 12, the crooks 9 and 10 either release or engage the hooks 7 and 8, so as to operate the rocker 4 and obtain, through the movements imparted on the heald frame 2 by the drawrod 1, the forming of the warp shed.

Figure 2:
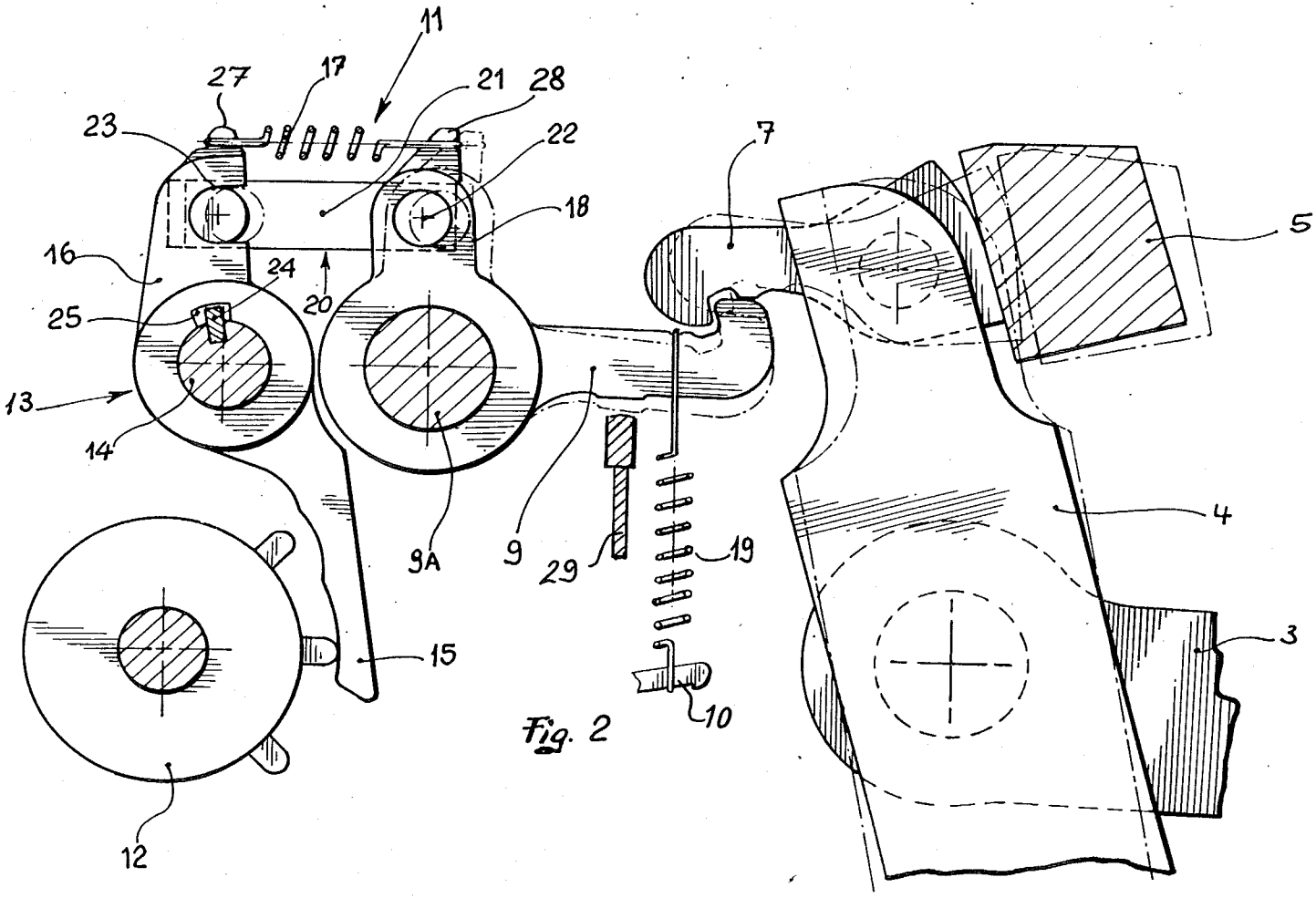
FIG. 2 shows, in detail, the means controlling the rocking movements of the crooks engaging the hooks, according to the present invention.

According to the invention, the spring and lever system 11, which controls the rocking movements of the crooks 9 and 10, comprises—for the crook 9 (FIG. 2)—a two-armed lever 13 pivoted on a shaft 14 parallel to the shaft 9A of the crook 9, the first arm 15 of said lever cooperating with the spiked roller 12, in order to read the fabric pattern coded on said roller, while the second arm 16 of said lever is connected, by way of a stout spring 17, to a square arm 18 of the crook 9. Arm 16 has a nob 27 on the end thereof. Arm 18 also has a nob 28 on the end thereof. Spring 17 is mounted to arms 16 and 18 around nobs 27 and 28. Crook 9 is urged downwardly—towards the position of disengagement from the hook 7—by a second weak spring 19 which is connected at either end to crooks 9 and 10, while stop means 20 are interposed between the arm 16 of the lever 13 and the arm 18 of the crook 9. Said stop means comprise a stiff bar 21, one end of which is pivotally mounted in 22 on the arm 18 of the crook 9, while the other end of said bar 24 moves freely in an open seat or slot 23 of the arm 16 of the lever 13. When the spring 17 is not opposed by the movements of the lever 13, produced by the spikes of the roller 12, the arm 16 moves toward arm 18 but is prevented from contacting the arm 18 due to bar 21 bearing at its end against the bottom of the seat 23 in arm 16. The end of the bar 21 leaves the bottom of seat 23 when the spikes of the roller 12 cause the rotation of the lever 13, thereby moving the arm 16 away from the arm 18. A stop 29 is positioned below crook 9 to limit its downward movement.

Figure 3:
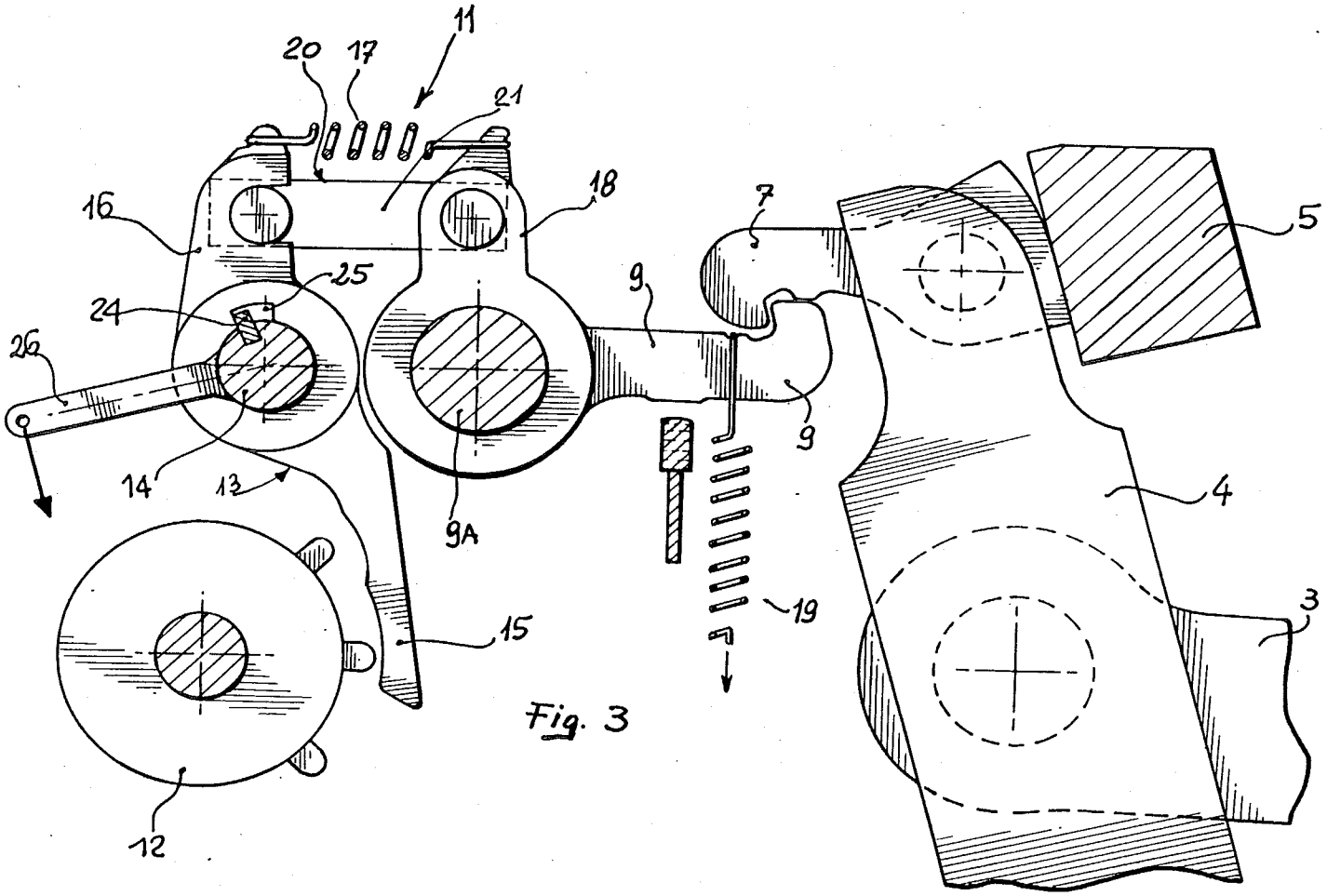
FIG. 3 is a view, similar to that of FIG. 2, showing also the means allowing an easy levelling of the heald frames, according to the arrangement of the invention.

The lever 13 is mounted rotatable on the shaft 14, but said rotation is limited to a very short arc (sufficient to guarantee the normal rocking movements of the lever 13) due to the presence, on the shaft 14, of a key 24 adapted to engage the ends of a wide circumferential slot 25 of the lever 13. Slot 25 is wide enough and suitably positioned for the oscillations of lever 13 produced by the spikes of roller 12 to take place freely, without key 24 hitting against the ends of the slot 25. Shaft 14 is fixed during operation. The key is used also to carry out a levelling operation. As shown in FIG. 3, the shaft 14 can be caused to rotate—for the purposes indicated hereinafter—by means of a pin or like 26.

In operation, the controls imparted by the spiked roller 12 on the arm 15 of the lever 13, are transmitted to the crook 9 merely by way of the spring 17, so that the strains deriving from the stresses to which the crook and its shaft 9A are subjected, are positively not adapted to affect said controls.

The crook 9 takes up its lowered position (dashed lines in FIG. 2), under the action of the weak spring 19, when the arm 15 of the lever 13 is not engaged by spikes of the roller 12, since in this case the action of the stouter spring 17 is not apt to approach the arms 16 and 18, which are kept slightly apart by the stop means 20.

When, instead, one of the spikes of the roller 12 causes the rotation of the lever 13 on its shaft 14, the arm 16 of said lever tends to oscillate the arm 18 of the crook 9, stretching the spring 17 against the weaker action of the return spring 19. When the crook 9 is released, it takes up the lifted position (continuous lines in FIG. 2) and, as the hook 7 touches it and presses thereon, the crook 9 is free to move down to the position shown in dashed lines in FIG. 2, rotating on its shaft 9A. The arm 18 of the crook 9 thus moves away from the arm 16 of the lever 13, the bar 21 of the stop means 20 leaving the end of the slot 23, wherein it however remains slidably positioned. With the crook 9 in a lowered position, the hook 7 can shift forward beyond said crook with a short idle stroke. When the hook 7 finally starts its backward stroke, it engages the crook 9—which has meanwhile returned to its lifted position—so as to determine the conditions of engagement shown in continuous lines in FIG. 2.

FIG. 3 shows how the arrangement according to the invention allows to operate the levelling of the heald frames in an exceptionally simple and practical manner. It is in fact sufficient to act with the pin 26 on the shaft 14 to rotate shaft 14 of the two-armed lever 13, so as to cause all of the keys 24 of the machine said to engage one of the ends of the slot 25 formed in the lever 13, thereby obtaining an identical positioning of all said levers and thus of all the heald frames. This allows to avoid using, for the levelling operation, the special complicated mechanisms which are normally provided on conventional dobbies.

With the arrangement according to the invention—wherein the controls transmitted to the crooks engaging the hooks are no longer affected by the strains deriving from the stresses imparted on said crooks—the stresses on the means reading the pattern of the fabric to be woven are almost inexistent, as they practically correspond to the stresses imparted on such means by the spring 19; this greatly improves the efficiency and precision of the controls, especially for what concerns the cooperation between the levers 13 and the spiked roller 12, and it provides the advantage of preserving the life of the machine components. It should also be noted that the stop means 20, according to this arrangement, adapt themselves perfectly to the deformation of the structure with which they cooperate, thereby favouring the proper mechanical behaviour of the whole unit.

It is understood that there may be other practical embodiments of the invention, falling within the protection scope of the invention itself.

I claim:

1. Negative dobby for forming a warp shed in weaving looms of a type wherein rocking movements imparted on rockers (4), which control the shifting of heald frames (2) by a pair of movable cross members (5, 6), are controlled by hooks (7, 8) pivoted to ends of said rockers (4) and by crooks (9, 10) cooperating with said hooks (7, 8) and operated by means (12) reading the pattern of the fabric to be woven comprising a rocking lever (13) having first and second arms, said first arm (15) cooperating with said pattern reading means (12); a square arm (18) on said crook (9); a spring (17) elastically connected to said second arm (16) and said square arm (18); stop means (20) interposed between said second arm (16) and said square arm (18); spring return means (19) biasing said crook (9) away from said hook (7); a first shaft (9A) around which square arm (18) pivots and a second shaft (14) around which rocking levers (13) pivot, the rocking movements of the crook (9) being controlled by said rocking lever (13).

2. Negative dobby as in claim 1, wherein said second arm (16) has an open slot (24) therein and said stop means (20) consist of a stiff bar (21), pivotally mounted on the square arm (18) of the crooks (9) and adapted to be freely inserted and to rotate into said open slot (23) of said second arm (16) of said two-armed lever (13).

3. Negative dobby as in claim 1, including a key (24) mounted in shaft (14) and wherein said two-armed lever (13) is mounted on shaft (14) so as to rotate thereon only for a short arc, the rotation being limited by a key (24) of said shaft (24) engaging into a wide circumferential slot (25) of the lever (13).

* * * * *